US006964273B1

(12) United States Patent
Bourgeois

(10) Patent No.: US 6,964,273 B1
(45) Date of Patent: Nov. 15, 2005

(54) OUTDOOR COOKING APPARATUS

(76) Inventor: Norman R. Bourgeois, 712 St. George Ave., Jefferson, LA (US) 70121

( * ) Notice: Subject to any disclaimer, the term of this patent is extended or adjusted under 35 U.S.C. 154(b) by 0 days.

(21) Appl. No.: 10/375,930

(22) Filed: Feb. 27, 2003

Related U.S. Application Data

(60) Provisional application No. 60/360,442, filed on Feb. 28, 2002.

(51) Int. Cl.[7] ..... F24C 3/08

(52) U.S. Cl. ..... 126/39 R; 126/39 B; 126/9 R; 126/2

(58) Field of Search ..... 126/39 R, 9 R, 126/2, 40, 39 B

(56) References Cited

U.S. PATENT DOCUMENTS 4,886,045 A * 12/1989 Ducate et al. ..... 126/41 R
4,934,333 A * 6/1990 Ducate et al. ..... 126/24
5,065,735 A * 11/1991 Bourgeois et al. ..... 126/40
5,203,317 A * 4/1993 James ..... 126/41 R

* cited by examiner

*Primary Examiner*—Alfred Basichas
(74) *Attorney, Agent, or Firm*—Garvey, Smith, Nehrbass & Doody, L.L.C.; Charles C. Garvey, Jr.

(57) ABSTRACT

An outdoor cooking apparatus includes a main burner section and an auxiliary burner section connectable thereto. A user can cook outdoors with either a single burner arrangement using the main burner section or a double burner arrangement using the main burner section and the auxiliary burner section connected thereto. Upon assembly, the burner sections each provide a burner element that are at respective differing elevational positions, the main burner section providing a burner element at a higher elevation and the auxiliary burner element providing a burner at a lower elevational position. The two burner sections are removably connectable so that the auxiliary burner section can be either connected to or disconnected from the main burner section as selected by a user.

56 Claims, 7 Drawing Sheets

OUTDOOR COOKING APPARATUS

CROSS-REFERENCE TO RELATED APPLICATIONS

Priority of U.S. Provisional Patent Application Ser. No. 60/360,442, filed Feb. 28, 2002, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to outdoor cooking devices that include a burner element that is fueled by a gaseous fuel product such as propane, butane or the like. Even more particularly, the present invention relates to an improved outdoor cooking apparatus that features a double burner cooking device having a main burner section and a removably connectable auxiliary burner section, each burner section having a grate upon which a pot can be placed and that is recessed below the top of the frame that supports and positions the burner element.

2. General Background of the Invention

Many commercially available cooking devices use propane or butane or other combustible gas as a fuel source. For many years, outdoor cooking devices have been manufactured and sold that include a hose for supplying propane or butane or like fuel to a burner element that is supported by a frame. Several such burner arrangements are seen in prior Norman Bourgeois U.S. Pat. Nos. 5,065,735; 5,813,321; 5,970,852; 6,058,830; 6,314,869; and 6,439,107.

Many prior art burner arrangements have been manufactured and sold by Metal Fusion, Inc. of Jefferson, Louisiana as contained in their annual catalog and on their web site (www.KingKooker.com).

Cabelas, Inc. of Sidney, Nebraska has offered for sale many outdoor cooking devices that are fueled by a tank or canister containing propane or butane connected to the cooking apparatus with a flexible hose.

BRIEF SUMMARY OF THE INVENTION

The present invention provides an improved outdoor cooking apparatus that provides two burners mounted on two separate frame sections, the frame sections being removably connectable together during use.

The frame sections include a main frame that is a taller frame and that supports a first burner element at a higher elevation. A second, auxiliary burner is mounted in a second frame at a lower elevation.

Each of the frame sections includes a frame having a top that is spaced above a provides a grate upon which a pot rests. In this fashion, a pot placed on either of the burner sections is somewhat recessed in that the top of the frame section extends above and surrounds the bottom of the pot.

BRIEF DESCRIPTION OF THE DRAWINGS

For a further understanding of the nature, objects, and advantages of the present invention, reference should be had to the following detailed description, read in conjunction with the following drawings, wherein like reference numerals denote like elements and wherein.

DETAILED DESCRIPTION OF THE INVENTION

Figure 1:
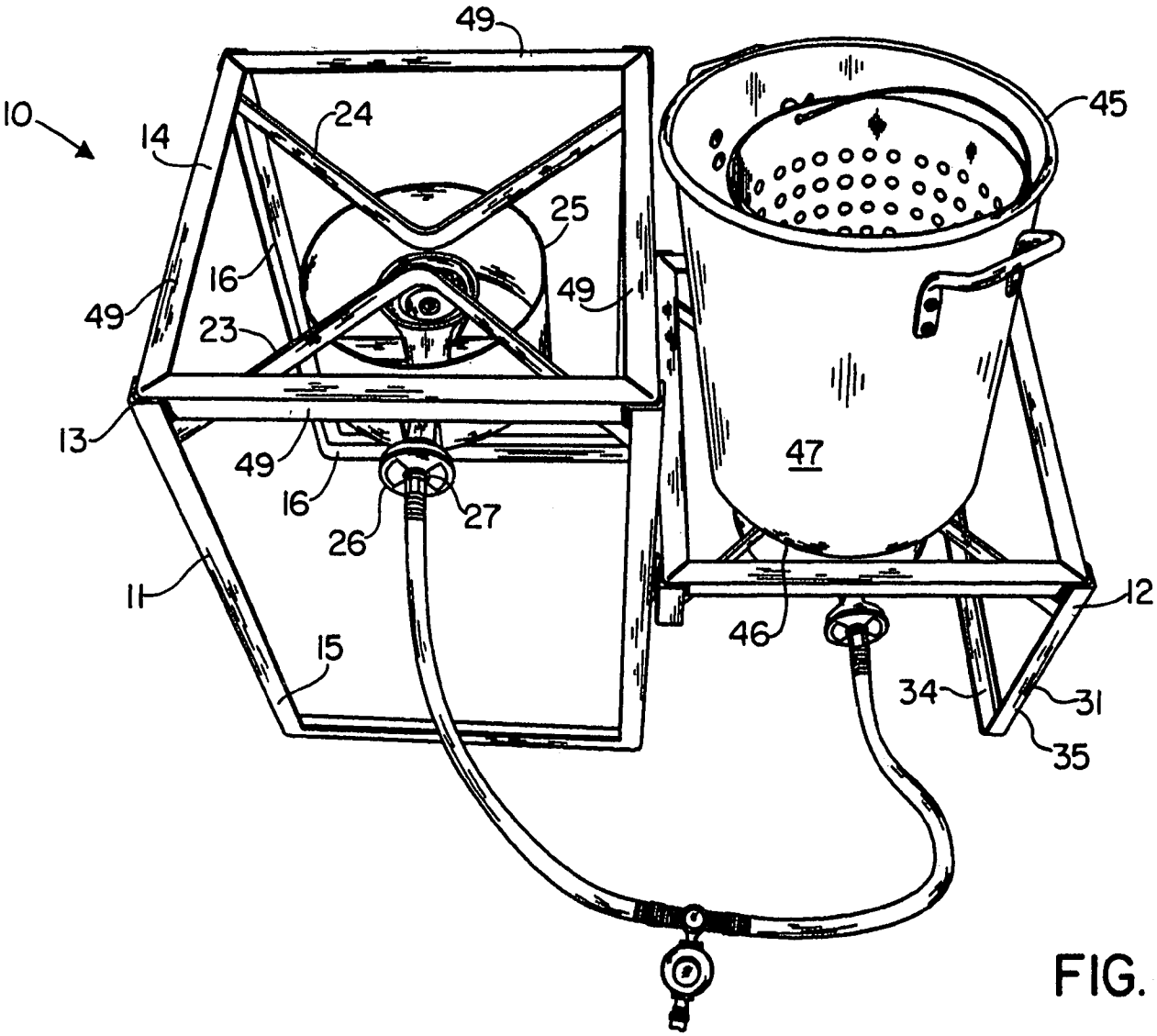
FIG. 1 is a rear perspective view of the preferred embodiment of the apparatus of the present invention, with a pot placed upon a lower one of the burner sections.
Figure 2:
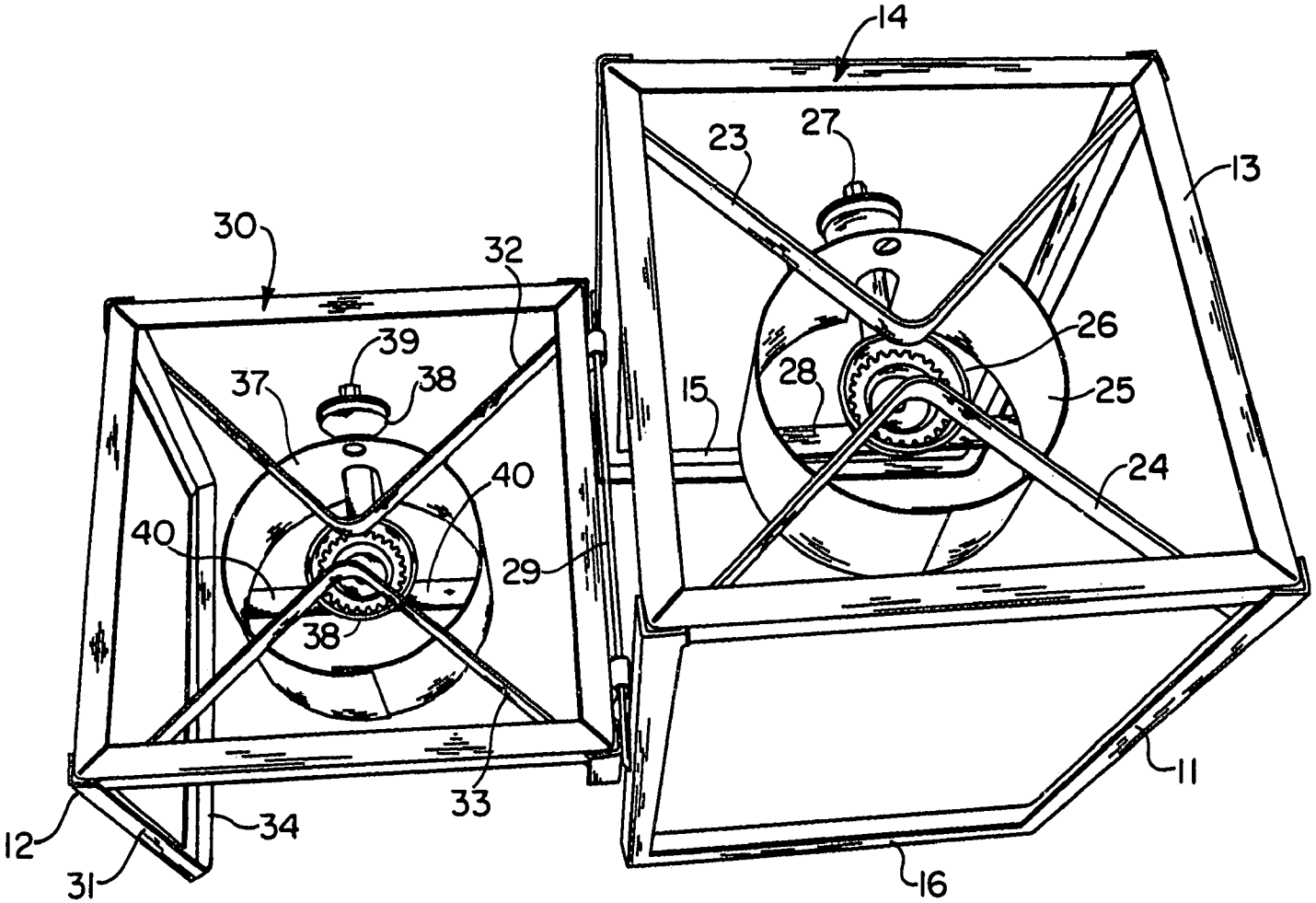
FIG. 2 is a front perspective view of the preferred embodiment of the apparatus of the present invention.
Figure 3:
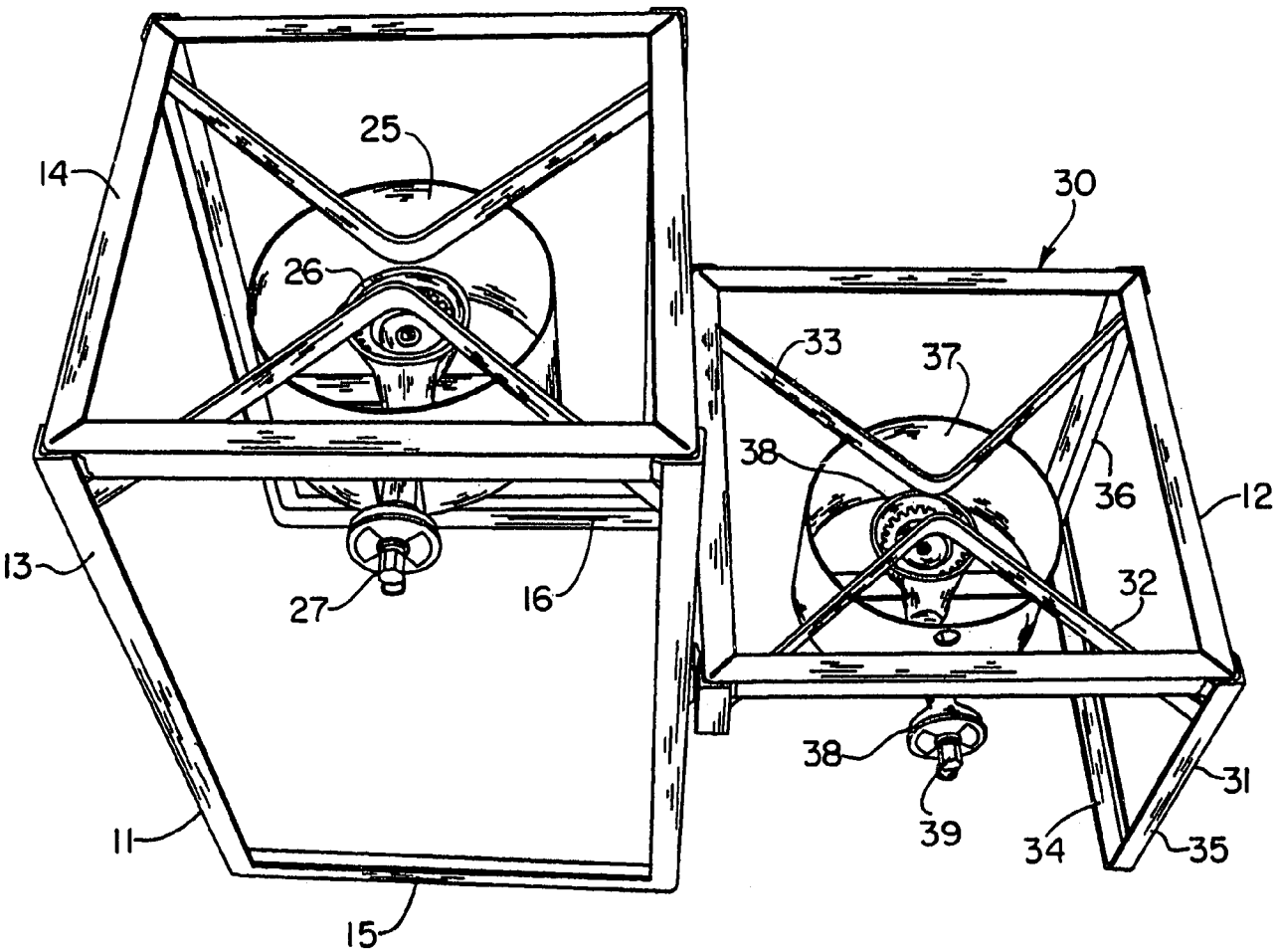
FIG. 3 is a rear perspective view of the preferred embodiment of the apparatus of the present invention.

FIGS. 1–3 show the preferred embodiment of the apparatus of the present invention, designated generally by the numeral 10.

Outdoor cooking apparatus 10 is comprised generally of a main burner section 11 and an auxiliary burner section 12. The main burner section 11 includes a frame 13 that has an upper generally rectangular top 14. The top 14 can be eg. rectangular or square and can be comprised of welded members such as for example, a plurality of flanged angle members 49 welded together end to end as shown in FIG. 3. A pair of U-shaped legs 15, 16 are connected to rectangular top 14 and include part of frame 13. The legs 15, 16 each include a plurality of vertical members and a single horizontal member that functions as a foot. For the first leg 15, there are provided a pair of vertical members 19, 20 and horizontal member 17 that functions as a foot. The leg 16 includes vertical members 21, 22 and horizontal member 18 that functions as a foot.

The main burner section 11 includes a pair of grate members 23, 24 that occupy a common plane and are provided for supporting the bottom 46 of a pot 45. The pot 45 has a side 47 and is generally cylindrically shaped, a portion of the side 47 of pot 45 extending below the rectangular top 14 of frame 13. Burner shroud 25 is connected to each of the grate members 23, 24 by welding, for example. In FIGS. 1–3, shroud 25 has an upper circular edge that connects to the bottom of each of the grate members 23, 24, with welded connections, for example.

A burner element 26 having fuel inlet 27 is supported within the interior of burner shroud 25 as shown in FIGS. 1–3, the bottom of burner element 26 resting upon burner support beam 28. The burner support beam 28 can be a strap member as shown that spans between opposing sides of shroud 25, being attached thereto by welding. Burner element 26 can be connected (for example, bolted) to burner support beam 28.

Figure 4:
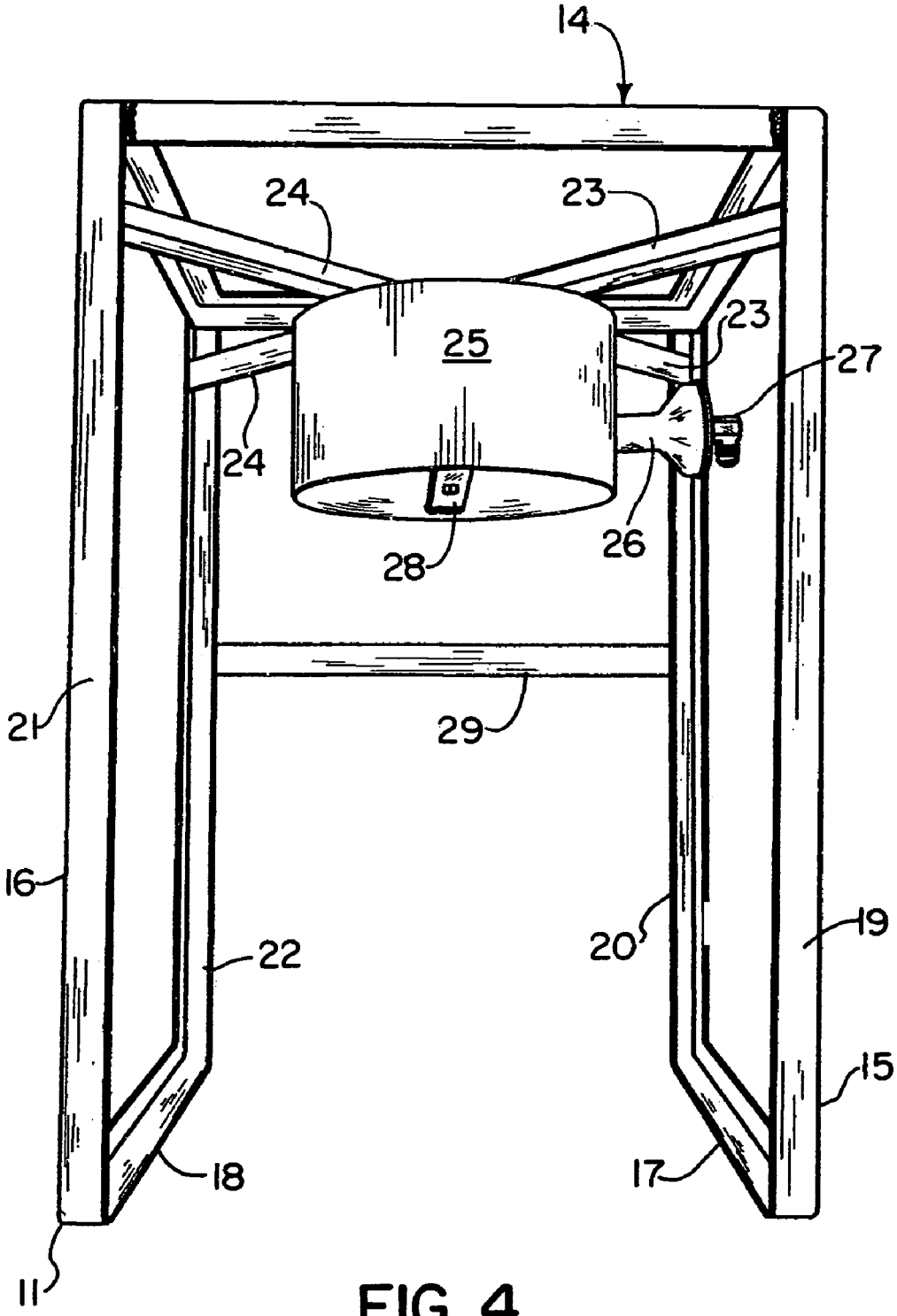
FIG. 4 is a side partial perspective view of the preferred embodiment of the apparatus of the present invention showing the main burner section.
Figure 5:
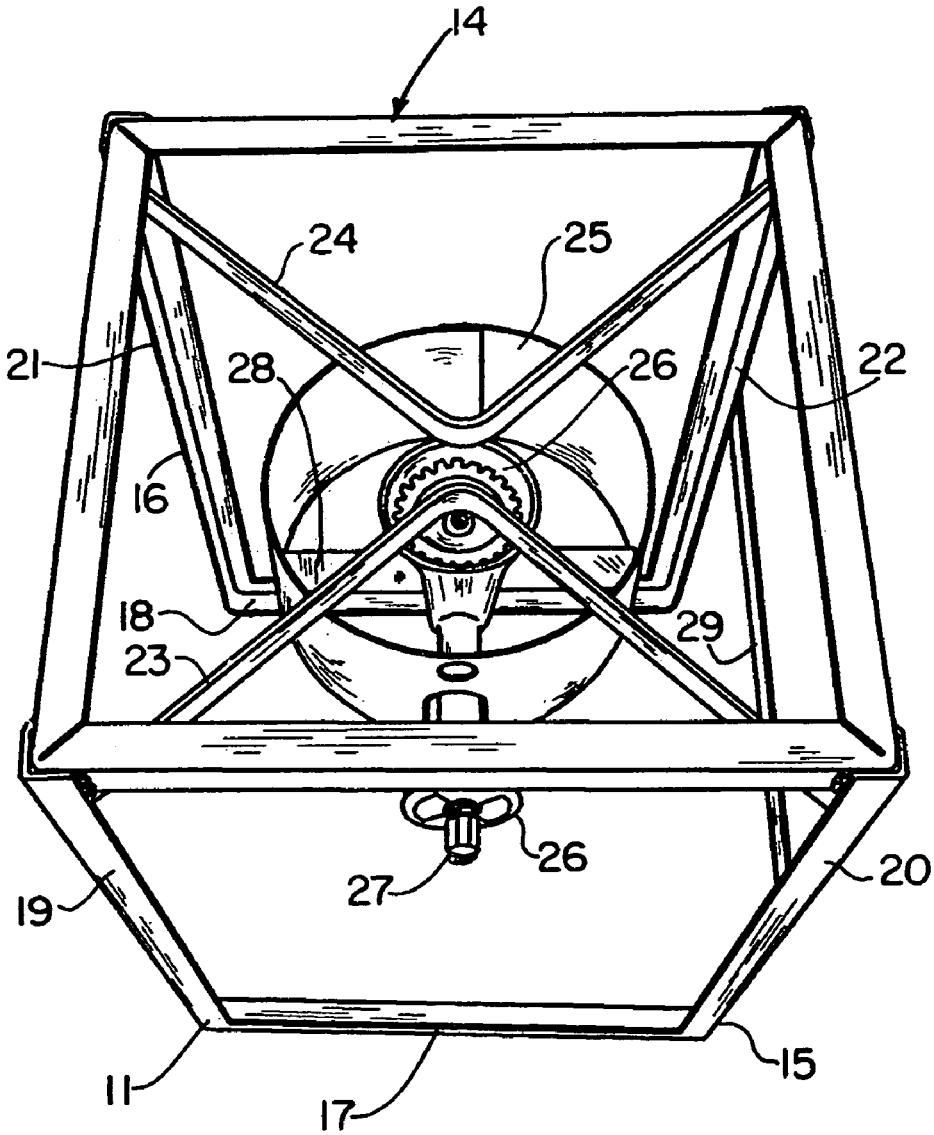
FIG. 5 is a partial perspective rear view of the preferred embodiment of the apparatus of the present invention showing the main burner section.
Figure 6:
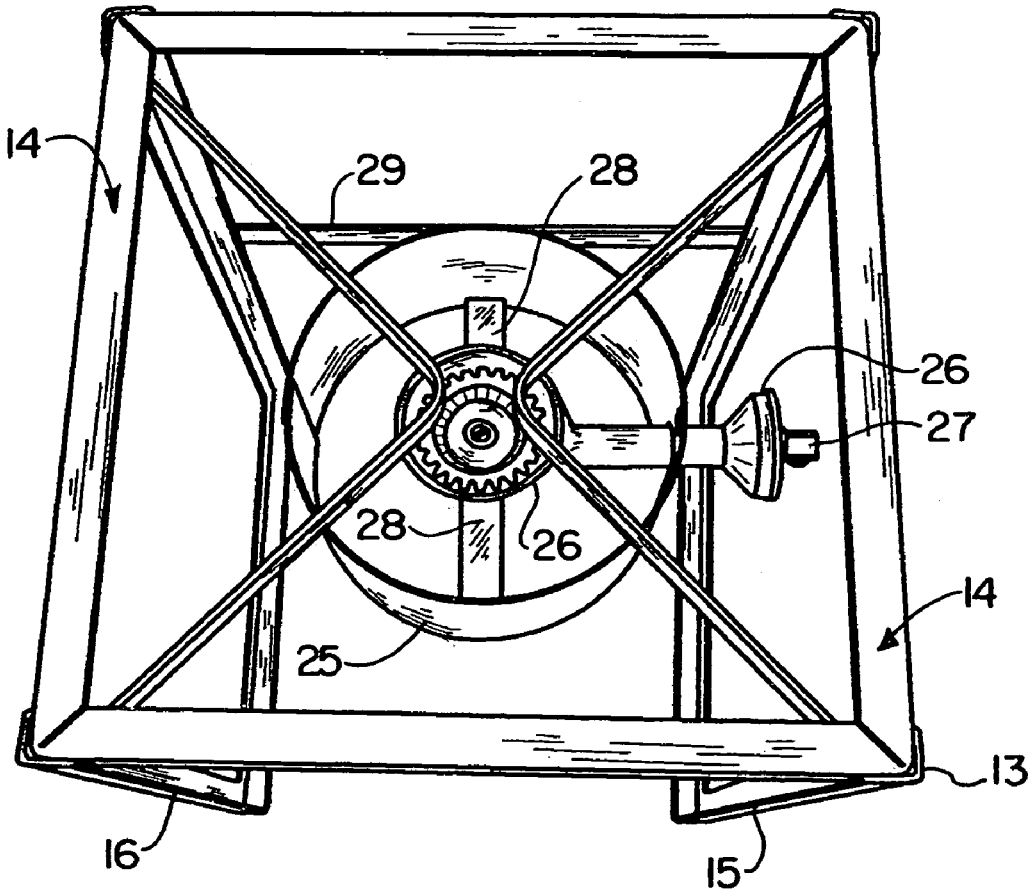
FIG. 6 is a fragmentary top view showing the main burner section.

A horizontal member in the form of auxiliary burner support strap 29 is provided on frame 13 (see FIGS. 4 and 6). The auxiliary burner section 12 attaches to the burner support strap 29 by means of a pair of spaced apart hook members 41, 42 provided on auxiliary burner section 12.

The auxiliary burner section 12 has a generally rectangular or square burner top 30 and a single burner leg that is generally U-shaped, designated by the numeral 31. Burner leg 31 includes a pair of vertical members 35, 36 and horizontal member 34 that functions as a foot for engaging an underlying support surface (for example, floor, slab, ground, etc.). The auxiliary burner section 12 has a pair of burner grates 32, 33 that are connected (for example, welded) to leg 31 and to the short vertical members 43, 44 that extend downwardly from burner top 30 and at positions generally opposite from leg 31 and its vertical members 35, 36.

Figure 8:
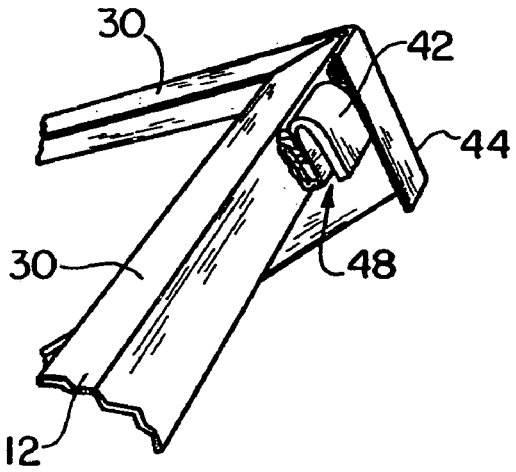
FIG. 8 is a fragmentary perspective view of the auxiliary burner section illustrating one of the connecting hook portions.
Figure 7:
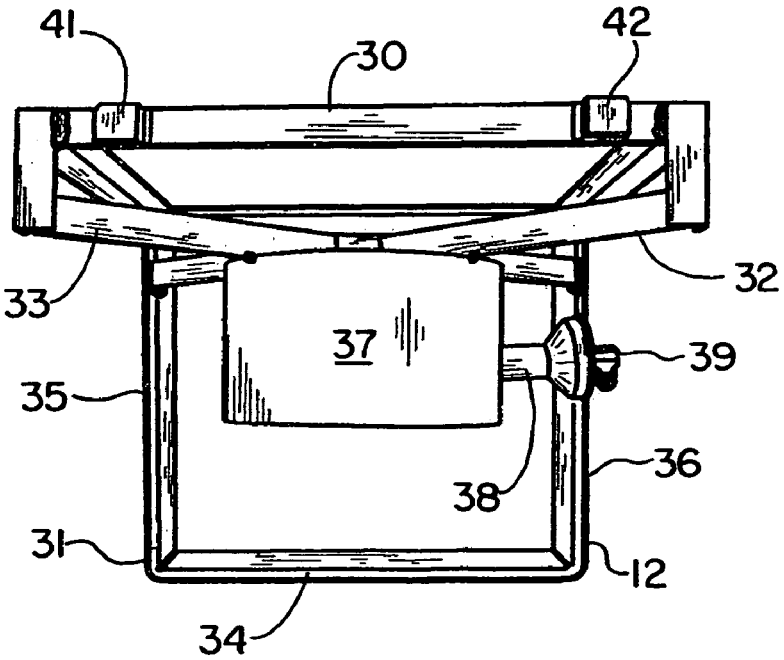
FIG. 7 is a fragmentary side perspective view of the preferred embodiment of the apparatus of the present invention showing the auxiliary burner section.

The hook members 41, 42 are attached to burner top 30 as shown in FIGS. 7 and 8. These hook members 41, 42 and burner top 30 are at an elevational position during use that is at the same elevation as the auxiliary burner support strap 29 on main burner section 11.

As with the main burner section 11, the auxiliary burner section 12 provides a burner shroud 37, burner element 38, and burner support beam 40. The burner support 40 can be a strap that extends across the bottom of shroud 37, being attached to shroud 37 with welded connections, for example. The burner element 38 provides a burner inlet 39 for supplying a gaseous fuel such as butane or propane via a flexible supply hose (not shown) for use in cooking. Such flexible hoses are well known in the art and commercially available as are the fuel tanks and regulators that are used to supply butane, propane and other gaseous fuels to an outdoor cooking apparatus.

During use, the present invention enables one or two cooking surfaces to be employed. The main burner section 11 can be used as a single burner when the auxiliary burner section 12 is removed therefrom. In order to provide a second burner, the auxiliary burner section can easily be added by engaging the burner support strap 29 of main burner section 11 with the hooks 43, 44 of auxiliary burner section 12. This arrangement can be seen in FIGS. 1 and 2.

The present invention is also easily transportable by nesting the auxiliary burner section 12 with the main burner section 11, both of the sections 11, 12 basically occupying the space of the single burner section 11. The grate members 23, 24 of main burner section 11 and the grate members 32, 33 of the auxiliary burner section 12 function not only as grate sections for supporting a pot 45, but also provide lateral strength to each of the main burner section 11 and auxiliary burner section 12.

The apparatus of the present invention can be manufactured of welded steel such as stainless steel or any like structural material that can withstand intense heat generated by a flame that is burning butane or propane. In the embodiment shown on the drawings, the main burner section 11 and its frame 13 is of a welded steel construction. Similarly, the auxiliary burner section 12 can be of a welded steel construction. The burner elements 26 and 38 are commercially available burner elements that are typically manufactured of cast iron or like material.

PARTS LIST

The following is a list of suitable parts and materials for the various elements of the preferred embodiment of the present invention.

| Part No. | Description |
|---|---|
| 10 | outdoor cooking apparatus |
| 11 | main burner section |
| 12 | auxiliary burner section |
| 13 | frame |
| 14 | top |
| 15 | U-shaped leg |
| 16 | U-shaped leg |
| 17 | horizontal member |
| 18 | horizontal member |
| 19 | vertical member |
| 20 | vertical member |
| 21 | vertical member |
| 22 | vertical member |
| 23 | grate member |
| 24 | grate member |
| 25 | burner shroud |
| 26 | burner element |
| 27 | fuel inlet |
| 28 | burner support beam |
| 29 | auxiliary burner support strap |
| 30 | burner top |
| 31 | burner leg |
| 32 | burner grate |
| 33 | burner grate |
| 34 | horizontal member |
| 35 | vertical member |
| 36 | vertical member |
| 37 | burner shroud |
| 38 | burner element |
| 39 | burner inlet fitting |
| 40 | burner support beam |
| 41 | hook member |
| 42 | hook member |
| 43 | short vertical member |
| 44 | short vertical member |
| 45 | pot |
| 46 | bottom |
| 47 | side |
| 48 | hook recess |
| 49 | angle member |

The foregoing embodiments are presented by way of example only; the scope of the present invention is to be limited only by the following claims.

What is claimed is:

1. A double burner, take apart cooking apparatus, comprising:

a) a pot having a pot bottom and pot sidewall that extends upwardly from the pot bottom;

b) a first burner section that includes a frame, the frame having a rectangular top portion and a bottom portion, the rectangular top portion defined by a plurality of perimeter beams connected together at corners and a plurality of legs, each leg connected respectively to a perimeter beam at a different corner, a first burner element supported upon the frame for burning gaseous fuel, and a connection for enabling a fuel source to be conveyed to the burner element;

c) a grate that is attached to the frame and positioned above the burner element and below the top of the burner section for holding a pot, wherein the bottom of the pot rests upon the pot support portion of the grate and the sides of the pot extend above and below the top of the frame so that the perimeter beams restrain lateral movement of the pot sidewall;

d) a wind guard attached to the frame and extending downwardly from the pot support portion of the grate, the wind guard surrounding the burner element;

e) a second, auxiliary burner section that is removably connectable to the first burner section and that includes a second burner element, and a grate for supporting a pot, wherein the burner elements are positioned at upper and lower elevational positions.

2. The cooking apparatus of claim 1 wherein the first burner section has a beam that spans between two of the legs, and the auxiliary burner section removably attaches to the beam.

3. The cooking apparatus of claim 1 wherein the first and second burner sections are each generally cube shaped.

4. The cooking apparatus of claim 3 wherein the first burner section is about twice as tall as the second burner section.

5. The cooking apparatus of claim 3 wherein each burner section has a plurality of legs.

6. The cooking apparatus of claim 6 wherein the legs include generally vertical members.

7. The cooking apparatus of claim 6 wherein the first burner section has four generally vertical members.

8. The cooking apparatus of claim 6 wherein the second burner section has two generally vertical members.

9. The cooking apparatus of claim 1 wherein the second burner section has a plurality of quick connect connectors for connecting the second burner section to the first burner section.

10. The cooling apparatus of claim 1, wherein the top or the second burner section is below the grate of the first burner section.

11. A double burner outdoor cooking apparatus, comprising:

a) a pot having a pot bottom and a pot sidewall;

b) a frame with a top portion, multiple corners, a plurality of legs, a bottom, the top portion being comprised of a plurality of perimeter beams connected together at the frame corners forming a polygon and an upper end portion of each leg, the frame supporting a first burner element;

c) a grate that is attached to the frame at the top portion for holding a pot, the grate providing a pot support that is positioned above the first burner element and below the perimeter beams, wherein the bottom of the pot rests upon the pot support and the sides of the pot extend above and below the perimeter beams; and d) a second burner element, that is spaced laterally from the first burner element and a second grate that enables a pot to be supported during cooking; and e) wind guards attached to and extending below each grate.

12. The cooking apparatus of claim 11 wherein the frame has legs and one or more beams that spans between the legs.

13. The cooking, apparatus of claim 11 wherein the frame includes one or more sections that are cube shaped.

14. The cooking apparatus of claim 13 wherein the first burner element is positioned about twice as high as the second burner element.

15. The cooking apparatus of claim 13 wherein the frame has a plurality of legs.

16. The cooking apparatus of claim 15 wherein each of the legs include spaced apart, generally vertical members.

17. A double burner outdoor cooking apparatus for supporting a cooking pot, comprising:

a) a frame with a bottom portion, a plurality of legs, a polygonal top portion defined by a plurality of linear perimeter beams connected at frame corner joints and an upper end portion of each leg of said plurality of legs, each leg position at a frame corner joint;

b) a pair of burner elements supported upon the frame for burning gaseous fuel;

c) a pair of grates on the frame that attach to the frame top portion, each grate having a pot support that is positioned above a burner element and below a plurality of the linear perimeter beams, wherein the bottom of the pot rests upon a grate not support during cooking and the sides of the pot extend above and below a plurality of the perimeter beams;

d) a pair of wind guards, each attached to one of the grates and extending downwardly therefrom, each wind guard extending around a burner element; and e) wherein the polygonal top portion includes a plurality of said linear beams, each beam having a beam and connected to another beam end at a corner joint, the beams defining a periphery, and wherein the grates and wind guards are positioned inside the periphery.

18. The double burner cooking apparatus of claim 17 wherein the top is a rectangular shape.

19. The double burner cooking apparatus of claim 17 wherein the frame section has four corners and at least one of the grates is attached to the frame at a plurality of the corners.

20. The double burner cooking apparatus of claim 17 wherein the frame has a plurality of corners, and each grate attaches to the frame at at least one of the plurality of corners.

21. The double burner cooking apparatus of claim 17 wherein each grate is an elongated member that has end portions that attach the grate to the frame.

22. The double burner cooking apparatus of claim 19 wherein each grate is an elongated member that has end portions that attach at the end portions to the frame.

23. The double burner cooking apparatus of claim 17 wherein the frame includes a pair of connectable sections and wherein a quick release connection joins one burner element to the other.

24. The double burner cooking apparatus of claim 23 wherein at least one of the burner elements has at least one generally u-shaped leg that has a transverse lower portion and two spaced apart upwardly extending portions that connect to the transverse lower portion.

25. The double burner cooking apparatus of claim 23 wherein the quick release connection includes a connecting part on the first burner element that is in between the top and bottom of the first burner element.

26. A double burner outdoor apparatus, comprising:

a) a frame with a frame top portion and a frame bottom portion;

b) a pair of burner elements supported upon the frame for burning gaseous fuel, the frame top portion being a polygonal top that is comprised of a plurality of beams and a plurality of corners that together define a periphery;

c) a pair of grates on the frame that are each positioned above at least one of the burner elements and below the top portion, each of the grates being structurally connected to the frame top portion so that each grate is capable of holding a pot;

d) a plurality of legs that connect to and support the frame, the top portion being in an elevated position, each leg having an upper end portion that is part of the frame top portion connecting to a corner;

e) wherein each grate is curved in part and attaches to the frame top portion;

f) the frame including a pair of wind guards, each being supported by at least one of the grates and extending downwardly therefrom, each wind guard having upper and lower edges; and g) each burner element being supported by the frame between at least one of the grates and the bottom of the frame.

27. A cooking apparatus, comprising:

a) a pot having a pot bottom and a pot sidewall;

b) a frame that includes a frame bottom portion, a frame top portion, a plurality of legs that span between the top and bottom portions, the top portion being comprised of a plurality of linear beams and a portion of each leg, the top portion being further defined by each linear beam connected to another linear beam at a frame corner joint and a connection of one of said legs to each frame corner joint;

c) the frame including a grate that is connected to the frame top portion, the grate including a pot support portion spaced below the linear beams to provide support for the pot bottom that is well below the linear beams;

d) wherein the linear beams are positioned above the pot support during cooking so that the linear beams restrict lateral movement of the pot sidewall during cooking;

e) a burner element positioned below the pot support, the burner element having an inlet that enables connection to a combustible gaseous fuel source for use in cooking;

f) a wind guard attached to the frame and extending downwardly from the pot support portion of the grate, the wind guard surrounding the burner element; and g) wherein the grate spaces the wind guard below the pot bottom.

28. The cooking apparatus of claim 27, wherein the first burner includes a plurality of vertical elements, each of the plurality of vertical elements having vertical and upper portions, the upper portions being positioned above the pot support and restricting a range of lateral pot movement during use, the vertical portions being substantially parallel to the pot's at least one vertical sidewall, the vertical portions being located at the vertices of a polygon having four or more sides.

29. The cooking apparatus of claim 27, wherein the upper portion surrounds the pot's at least one vertical wall.

30. The cooking apparatus of claim 27, wherein the upper portion of the at least one vertical element is in the shape of a polygon.

31. The cooking apparatus of claim 28, wherein the polygon is a rectangle.

32. The cooking apparatus of claim 28, wherein the polygon is a square.

33. The cooking apparatus of claim 27, wherein the first burner section has a pair of legs and a beam that spans between the legs.

34. The cooking apparatus of claim 27, wherein the first burner has a plurality of legs.

35. The cooking apparatus of claim 34, wherein the legs include generally vertical members.

36. The cooking apparatus of claim 27, wherein the first burner has four generally vertical members.

37. The cooking apparatus of claim 27, wherein the frame has legs and one or more beams that spans between the legs.

38. The cooking apparatus of claim 27, further comprising a wind guard at least partially covering the first burner element.

39. The cooking apparatus of claim 27, wherein the frame includes one or more sections that are cube shaped.

40. The cooking apparatus of claim 34, wherein each of the legs includes spaced apart, generally vertical members.

41. The cooking apparatus of claim 27, wherein the frame has four corners and at least one grate attached to the frame at a plurality of the corners.

42. The cooking apparatus of claim 27, wherein the frame has a plurality of corners, and at least one grate attached to the frame at at least one of the plurality of corners.

43. The cooking apparatus of claim 42, wherein each grate includes an elongated member that has end portions that attach the grate to the frame.

44. The cooking apparatus of claim 27, wherein the burner element has at least one generally u-shaped leg that has a transverse lower portion and two spaced apart upwardly extending portions that connect to the transverse lower portion.

45. A cooking apparatus, the apparatus comprising:

a) a pot having a pot bottom and a pot sidewall extending upwardly from the pot bottom;

b) a frame that includes a frame top portion, a frame bottom portion , multiple legs that span between the frame top and bottom portions, the top portion including a plurality of beams connected together to provide frame corners and an upper end portion of each leg that connects to a frame corner;

b) the burner attached to the frame;

c) the frame including a grate having a pot support positioned to hold the pot at a position below the linear beams when the pot is placed on the frame;

d) the linear beams being positioned above the pot support and restricting a range of lateral pot movement during use; and e) wherein the pot support is comprised of a pair of grates, each grate connecting to the frame upper end portion.

46. The cooking apparatus of claim 45, wherein the frame upper end portion surrounds the pot side wall.

47. The cooking apparatus of claim 45, wherein the linear beams form a polygon.

48. The cooking apparatus of claim 45, wherein the polygon is a rectangle.

49. The cooking apparatus of claim 45, wherein the frame bottom portion includes a part of each leg and a beam that spans between the legs.

50. The cooking apparatus of claim 45, wherein the legs include generally vertical members.

51. The cooking apparatus of claim 45, wherein the legs are at least four generally vertical members.

52. The cooking apparatus of claim 45, wherein the frame has one or more beams that spans between the legs.

53. The cooking apparatus of claim 45, wherein at least one grate is attached to the frame at a plurality of the corners.

54. The cooking apparatus of claim 45, wherein the frame has a plurality of corners, and at least one grate attached to the frame at a plurality of the corners.

55. The cooking apparatus of claim 54, wherein each grate includes an elongated bent member that has end portions that attach the grate to the frame.

56. The cooking apparatus of claim 45, further comprising an auxiliary burner section that is removably connectable to the first burner frame and that includes a second burner element for generating a high intensity flame for use in cooking, the auxiliary burner having a pot support.

* * * * *